United States Patent [19]

Bar-on

[11] 4,027,138

[45] May 31, 1977

[54] FUSER RELEASE MATERIAL DISPENSER

[75] Inventor: Ari Bar-on, Rochester, N.Y.

[73] Assignee: Xerox Corporation, Stamford, Conn.

[22] Filed: Mar. 25, 1976

[21] Appl. No.: 670,315

[52] U.S. Cl. ..... 219/216; 118/60; 432/75

[51] Int. Cl.² ..... G03G 15/20

[58] Field of Search ..... 219/216, 388; 432/60, 432/75, 228; 118/60; 355/3 FU

[56] References Cited

UNITED STATES PATENTS 3,918,397 11/1975 Thettu ..... 432/228 X 3,929,094 12/1975 Thettu ..... 118/60

*Primary Examiner*—C. L. Albritton

*Attorney, Agent, or Firm*—J. J. Ralabate; H. Fleischer; C. A. Green

[57] ABSTRACT

An apparatus in which heat settable particles are substantially permanently affixed to a sheet. The apparatus includes a fuser member having a supply of release material applied thereto from a chamber in a housing. The release material is a liquid when the fuser member is at its operating temperature. However, when the fuser member is de-energized, the release material solidifies. Baffles are provided in the chamber of the housing to facilitate solidification of the release material adjacent to the fuser member.

8 Claims, 2 Drawing Figures

FUSER RELEASE MATERIAL DISPENSER

BACKGROUND OF THE INVENTION

This invention relates generally to a fusing apparatus employed in an electrostatographic printing machine, and more particularly concerns an apparatus for applying release material to a heated fuser member employed therein.

In the process of electrostatographic printing, a latent image is recorded on a surface and rendered visible with particles. These particles may be transferred to a sheet of support material, in image configuration, or remain on the surface. In either case, the particles are permanently affixed to the sheet of support material or surface. In this manner, a copy of an original document is formed. Electrostatographic printing includes both electrophotographic and electrographic printing. Electrophotographic printing employs a light image of the original document to dissipate a charged photoconductive surface. This results in a latent image of the original document being recorded on the photoconductive surface. Electrographic printing does not employ a photoconductive member or a light image to create a latent image of the original document. Generally, both of the foregoing processes employ heat settable particles to develop the latent image. These heat settable particles are permanently affixed to the copy sheet by the application of heat thereto.

Many different types of systems have been developed for applying heat to the particles on the copy sheet. For example, the sheet of support material may pass between a pair of opposed rollers. In a system of this type, one of the rollers is heated while the other roller may be unheated. The outer surface of the heated roller frequently is covered with a polytetrafluoroethylene coating, commonly known as Teflon, to which a release agent, such as silicone oil is applied. An alternate system employs a bare metal heated roller having a low molecular weight polyethylene applied thereto. In this latter technique, the release materials, i.e., polyethylene, is generally a solid at room temperature. However, when the bare metal roll is heated, the release agent liquifies. It has been found that during solidification, the release agent tends to shrink. Solidification starts at the far end of the chamber storing the release material and consequently shrinks away from the fuser.

Accordingly, it is a primary object of the present invention to improve the release agent applying apparatus by constraining the release agent to solidify more closely proximate to the fuser roll.

SUMMARY OF THE INVENTION

Briefly stated, and in accordance with the present invention, there is provided an apparatus for affixing substantially permanently heat settable particles to a sheet.

Pursuant to the features of the present invention, the apparatus includes a fuser member and a back-up member cooperating therewith to define a nip through which the sheet having the particles thereon passes. A release material, in operative communication with the fuser member, is stored in the chamber of the housing. Means, associated with the housing, are provided for controlling solidification of the release material in the housing chamber.

BRIEF DESCRIPTION OF THE DRAWINGS

Other objects and advantages of the present invention will become apparent upon reading the following detailed description and upon reference to the drawings, in which.

While the present invention will hereinafter be described in connection with a preferred embodiment thereof, it will be understood that it is not intended to limit the invention to this embodiment. On the contrary, it is intended to cover all alternatives, modifications and equivalents as may be included within the spirit and scope of the invention as defined by the appended claims.

DETAILED DESCRIPTION

Figure 1:
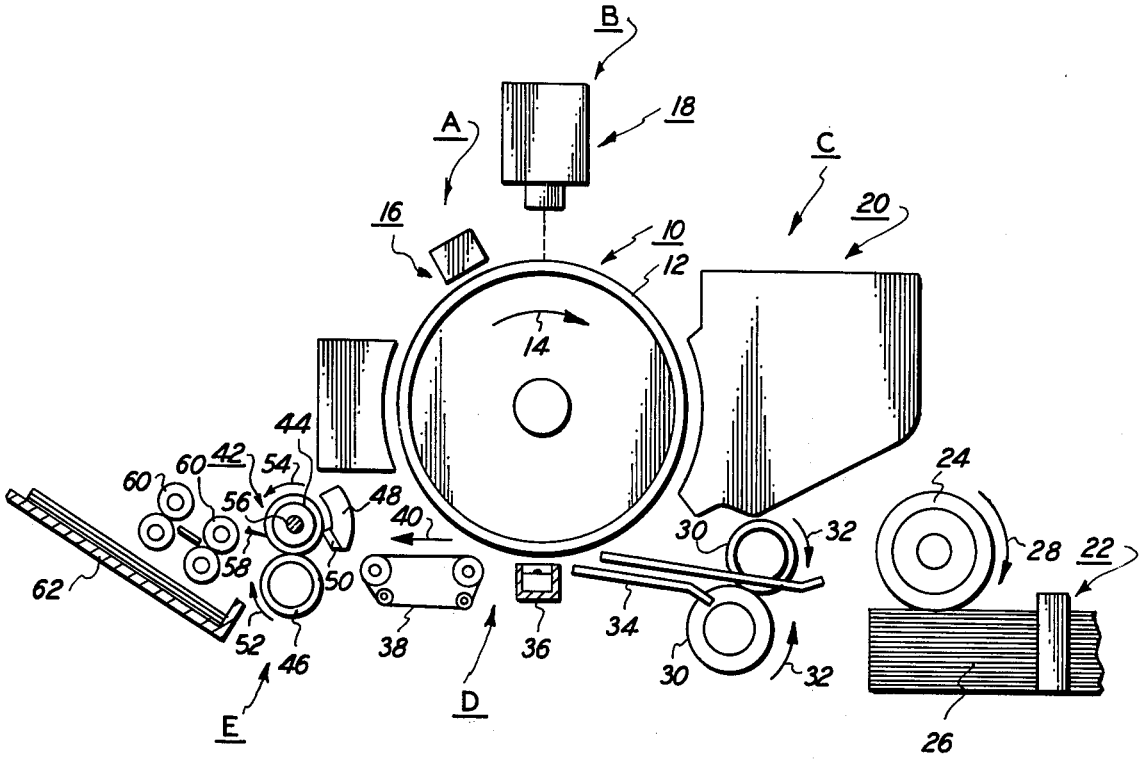
FIG. 1 is a schematic elevational view illustrating an electrophotographic printing machine incorporating the features of the present invention therein.

For a general understanding of an electrophotographic printing machine in which the features of the present invention may be incorporated, reference is had to FIG. 1 which depicts schematically the various components thereof. In the drawings, like reference numerals have been employed throughout to designate identical elements. Although the apparatus for controlling the solidification of the release material in the storage chamber thereof is particularly well adapted for use in the FIG. 1 electrophotographic printing machine, it will become evident from the following discussion that it is equally well suited for use in a wide variety of devices and is not necessarily limited in its application to the particular embodiment shown herein.

Inasmuch as the practice of electrophotographic printing is well known in the art, the various processing stations for producing a copy of an original document will be represented only schematically in FIG. 1.

As shown in FIG. 1, the electrophotographic printing machine employs a drum 10 having a photoconductive surface 12 entrained about and secured to the exterior circumferential surface thereof. Drum 10 rotates in the direction of arrow 14 to pass through the processing stations disposed about the periphery thereof. A suitable photoconductive material may be a selenium alloy of a type described in U.S. Pat. No. 2,970,906 issued to Bixby in 1961.

Initially, drum 10 rotates a portion of photoconductive surface 12 through charging station A. At charging station A, a corona generating device, indicated generally by the reference numeral 16, charges a portion of photoconductive surface 12 to a relatively high substantially uniform potential. One type of suitable corona generating device is described in U.S. Pat. No. 1,836,725 issued to Vyverberg in 1958.

Thereafter, the charged portion of photoconductive surface 12 rotates to exposure station B. Exposure station B includes an exposure mechanism, indicated generally by the reference numeral 18. Exposure mechanism 18 includes a stationary housing comprising a transparent platen, such as a glass plate or the like, arranged to support the original document thereon. Lamps illuminate the original document. Scanning of the original document is achieved by oscillating a mirror in a timed relationship with the movement of drum 10, or by translating the lamp and lens system across the original document to create successive incremental light images. These light images are projected, in a time relationship, onto the charged portion of photoconductive surface 12. In this way, the light image of the original document irradiates the charged photoconductive surface dissipating the charge thereon. This records an electrostatic latent image corresponding to the informational areas contained within the original document.

After the electrostatic latent image is recorded on photoconductive surface 12, drum 10 rotates to development station C. At development C, developer unit 20 brings a developer mix of carrier granules and toner particles into contact with the electrostatic latent image. Preferably, developer unit 20 is a magnetic brush development system wherein the developer mix is brought through a directional flux field forming a brush thereof. The brush of developer mix contacts the electrostatic latent image recorded on photoconductive surface 12. Toner particles are attracted electrostatically from the carrier granules to the latent image forming a powder image on photoconductive surface 12.

Sheet feed apparatus 22 advances a sheet of support material, in synchronism with the rotation of drum 10, to transfer station D. Sheet feeding apparatus 22 includes feed roll 24 in contact with uppermost sheet of stack 26. Feed roll 24, rotating in the direction of arrow 28, advances successive uppermost sheet from stack 26. Registration rolls 30, rotating in the direction of arrow 32, align and forward the advancing sheet into chute 34. Chute 34 directs the sheet into contact with the photoconductive surface 12, in registration with the toner powder image thereon. Hence, the sheet of support material contacts the toner powder image at transfer station D.

Transfer station D includes a corona generating device, indicated generally by reference numeral 36. Corona generating device 36 applies a spray of ions onto the backside of the sheet of support material opposed from photoconductive surface 12. The toner powder image adhering to photoconductive surface 12 is attracted from the latent image to the sheet of support material. After transferring the toner powder image to the sheet of support material, endless belt conveyor 38 advances the sheet of support material, in the direction of arrow 40, to fusing station E.

Fusing station E includes a fuser assembly, indicated generally by the reference numeral 42. Fuser assembly 42 heats the transferred toner powder image to permanently affix it to the sheet of support material. A heated fuser member or roll, shown generally by the reference numeral 44, cooperates with a back-up member or roll 46 to define a nip through which the sheet of support material passes. The sheet of support material passes through the nip with the toner powder image thereon contacting fuser roll 44. Dispenser 48 applies release material to fuser roll 44. Metering blade 50 is positioned closely adjacent to fuser roll 44 to adjust the thickness of the release material layer applied thereto. A channel shaped base is provided for supporting fuser assembly 42 in the electrophotographic printing machine. Back-up roll 46 is mounted rotatably on a pair of brackets secured to the channel shaped base by means of a right angle bracket. As shown, back-up roll 46 is adapted to rotate in the direction of arrow 52. Preferably, back-up roll 46 includes a rigid steel core mounted rotatably on a shaft. An elastomeric surface or layer, preferably made of Viton, is entrained about the core and secured thereto.

A pair of brackets having a generally E-shaped configuration are provided for mounting fuser roll 44 rotatably in fuser assembly 42. A pair of ball bearings, one in each of the support brackets, are provided for this purpose. Retaining rings secure the bearings in the brackets. A pair of end caps are secured to a hollow cylindrical core. The end caps have reduced end portions so as to be mounted in the bearings permitting fuser roll 44 to rotate in the direction of arrow 54. A heating element 56 is supported internally of fuser roll 44 for providing thermal energy thereto. This raises the temperature of fuser roll 44 to its operating temperature. Preferably, heating element 56 includes a quartz envelope having a tungston resistance heating element enclosed therein. In this way, heating element 56 elevates the temperature of fuser roll 44 to an operational temperature ranging from about 285° F to about 295° F. Preferably, fuser roll 44 is fabricated from any suitable material capable of efficiently conducting heat to the exterior surface thereof. Suitable materials are aluminum and alloys thereof, steel, stainless steel, nickel and nickel alloys thereof, nickel plated copper, chromium plated copper, copper and alloys thereof. In operation, fuser roll 44 requires about 420 watts peak power with the average power being about 320 watts, and about 100 watts being provided for stand-by operation. Heating element 56 is supported internally of fuser roll 44 by a pair of spring supports which are mounted in an insulating block secured to support brackets. The free ends of the spring supporting the elements are provided with a locating ball in contact with an electrical terminal to which electrical wires may be attached for applying electrical energy to heating element 56.

Dispenser 48 includes a housing 66 (FIG. 2) defining a chamber 68 (FIG. 2) for storing the release material therein. Fuser roll 44 has a portion thereof rotating in chamber 68 of housing 66. End seals 72 (FIG. 2) are provided to prevent fluid leakage. In this way, release material is applied to fuser roll 44. The release material is, preferably, a low molecular weight substance which is solid at room temperature and has a low relative viscosity at the operating temperature of fuser roll 44. An example of such a material is polyethylene manufactured by Allied Chemical Company and having the designation AC-8 homopolymer. Thus, a layer of the release material is coated on fuser roll 44 as a portion thereof passes through chamber 68 in housing 66 of dispenser 48. Baffle plates 70 (FIG. 2) are provided to control solidification of the release material. The detailed structural arrangement of dispenser 48 will be discussed hereinafter in greater detail with reference to FIG. 2.

After the toner powder image is permanently affixed to the sheet of support material, stripper blade 58 ensures that the sheet is separated from fuser roll 44. The sheet of support material is then advanced by a series of rollers 60 to catch tray 62 for subsequent removal therefrom by the machine operator.

Invariably, after the sheet of support material is separated from photoconductive surface 12, some residual toner particles remain adhering thereto. These residual toner particles are removed from photoconductive surface 12 at cleaning station F. Cleaning station F includes a cleaning mechanism, designated generally by the reference numeral 64, having a corona generating device and brush. Initially, toner particles are brought under the influence of the corona generating device (not shown) to neutralize the remaining electrostatic charge on photoconductive surface 12 and that of the residual toner particles. These neutralized toner particles are then cleaned from photoconductive surface 12 by a rotatably mounted fibrous brush in contact therewith.

After cleaning, a discharge lamp floods photoconductive surface 12 with light to dissipate any residual charge thereon. Thus, the charge on photoconductive surface 12 is returned to its initial level prior to the recharging thereof.

It is believed that the foregoing description is sufficient for purposes of the present application to illustrate the general operation of an electrophotographic printing machine incorporating a fusing apparatus having the features of the present invention therein.

Figure 2:
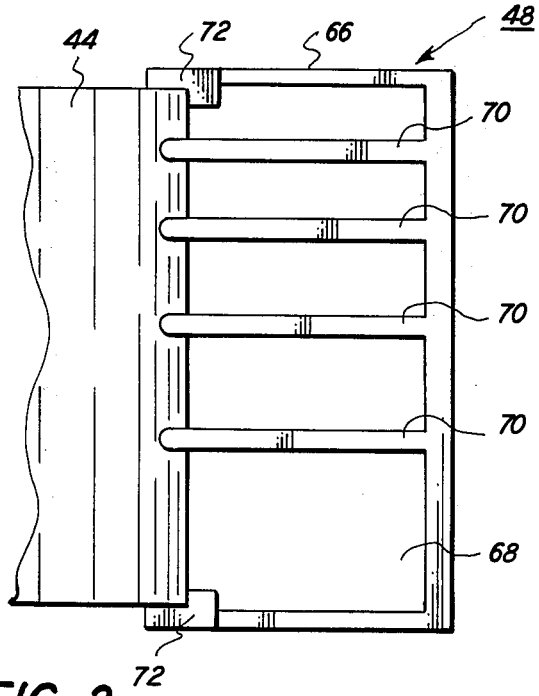
FIG. 2 is a schematic plan view depicting the housing storing the release material applied to the FIG. 1 printing machine fuser roll.

Referring now to the specific subject matter of the present invention, FIG. 2 depicts a portion of the fusing system and the dispenser associated therewith. Housing 66 defines a chamber 68 for storing a supply of release material therein. A plurality of baffle plates 70 extend into chamber 68 of housing 66 in a direction substantially normal to the longitudinal axis of the fuser roll 44. Baffle plates 70 compartmentalize chamber 68 to prevent splashing or sloshing of the release material when it is in the liquid state. In particular, baffle plates 70 control splashing and sloshing of the release material during the withdrawal and insertion of the fusing apparatus into the printing machine. Fusing apparatus 42 is mounted slidably in the printing machine. This enables the fusing apparatus to be withdrawn from the printing machine for service, paper jam clearance, and addition of release material. In addition, baffle plates 70 provide a surface upon which the release material solidifies when fuser roll 44 is de-energized, i.e., heating element 56 is de-activated. End seals 72 prevent release material from leaking out of chamber 68. As hereinbefore indicated, fuser roll 44 passes through a portion of chamber 68 so as to have release material applied thereto. After passing through chamber 68, metering blade 50 (FIG. 1) has the leading edge portion thereof closely adjacent to fuser roll 44. In this way, metering blade 50 regulates the thickness of the layer of release material applied to fuser roll 44. Preferably, baffle plates 70 are made from a metallic material so that the surface thereof is chilled relative to the surrounding environment when heating element 56 is de-energized. Thus, the surface of baffle plates 70 is at a lower temperature than the surrounding environment to provide a surface upon which the release material solidifies. In this way, the solidified release material is positioned closely adjacent to the fuser roll permitting the more rapid heating thereof when the copying machine is reactivated.

In recapitulation, it is apparent that, pursuant to the features of the present invention, the apparatus of the present invention controls the solidification of the release material in the chamber of the storage housing so that it solidifies closely adjacent to the fuser roll. Moreover, the baffle plates also act to control splashing and sloshing of the release material when the fusing apparatus is withdrawn or inverted into the printing machine. In this manner, the solidified release material is liquified more rapidly due to its close proximity to the heated fuser roll. This permits a more rapid activation of the electrophotographic printing machine reducing the warm-up time required to make the first copy therein.

It is, therefore, evident that there has been provided, in accordance with the present invention, an apparatus for permanently affixing heat settable particles to a sheet wherein the solidification of the release material contained in the storage housing is controlled. The apparatus of the present invention fully satisfies the objects, aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. An apparatus for affixing substantially permanently heat settable particles to a sheet, including:

an elongated fuser member;

a back-up member cooperating with said fuser member to define a nip through which the sheet having the particles thereon passes;

a housing defining a chamber for storing a supply of release material in operative communication with said fuser member;

means for heating said fuser member to at least a temperature sufficient to substantially permanently affix the particles to the sheet and to change the state of the release material from a solid to a liquid; and means, associated with said housing, for controlling solidification of the release material in the chamber of said housing said controlling means comprising a baffle plate extending substantially normal to the longitudinal axis of said furser member and being disposed such that a substantial portion of the liquid release material solidifies thereon upon the de-energization of said heating means.

2. An apparatus as recited in claim 1, wherein said controlling means includes at least one baffle plate disposed in the chamber of said housing.

3. An apparatus as recited in claim 2, wherein:

said fuser member includes a first roll; and said back-up member includes a second roll in engagement with said first roll to define a nip through which the sheet passes.

4. An apparatus as recited in claim 3, further including means for regulating the thickness of the layer of release material applied to said first roll.

5. An electrostatographic printing machine of the type having an elongated fuser member cooperating with the back-up member to define a nip through which a sheet of support material having toner particles thereon passes, wherein the improvement includes:

a housing defining a chamber for storing a supply of release material in operative communication with said fuser member;

means for heating the fuser member to at least a temperature sufficient to substantially affix the particles to the sheet and to change the state of the release material from a solid to a liquid; and means associated with said housing, for controlling the solidification of the release material in the chamber of said housing, said controlling means comprising a baffle plate extending substantially normal to the longitudinal axis of said fuser member and being disposed such that a substantial portion of the liquid release material solidifies thereon upon the de-energization of said heating means.

6. A printing machine as recited in claim 5, wherein said controlling means includes at least one baffle plate disposed in the chamber of said housing.

7. A printing machine as recited in claim 6, wherein:

the fuser member includes a first roll; and the back-up member includes a second roll in engagement with the first roll to define a nip through which the sheet passes.

8. A printing machine as recited in claim 7, further including means for regulating the thickness of the layer of release material applied to the first roll.

* * * * *